United States Patent [19]

Mulfarth et al.

[11] Patent Number: 4,787,568

[45] Date of Patent: Nov. 29, 1988

[54] WINDING APPARATUS FOR CONTINUOUS STRIPS OF MATERIAL

[75] Inventors: Werner Mülfarth, Kirchheim; Dragan Djordjevic, Erkrath, both of Fed. Rep. of Germany

[73] Assignee: ER-WE-PA Maschinenfabrik und Eisengiesserei GmbH, Erkrath, Fed. Rep. of Germany

[21] Appl. No.: 104,380

[22] Filed: Oct. 5, 1987

[30] Foreign Application Priority Data

Oct. 4, 1986 [DE] Fed. Rep. of Germany ..... 3633897

[51] Int. Cl.[4] ..... B65H 19/22

[52] U.S. Cl. ..... 242/56.9; 242/56.2; 242/67.1 R; 242/68

[58] Field of Search ..... 242/55.2, 55.3, 56 R, 242/56.2, 56.9, 57.1, 58, 60, 67.1 R, 68, 68.1, 68.2, 72 R, 72 B

[56] References Cited

U.S. PATENT DOCUMENTS

| | | | |
|---|---|---|---|
| 2,840,320 | 6/1958 | Csutor | 242/68 |
| 3,406,924 | 10/1968 | Bruns et al. | 242/56.9 X |
| 3,977,617 | 8/1976 | Salmon | 242/68 X |
| 3,997,124 | 12/1976 | Sato | 242/68 |
| 4,063,692 | 12/1977 | Buggy | 242/56.9 |
| 4,270,707 | 6/1981 | Sharlow | 242/56.9 |
| 4,346,852 | 8/1982 | Kawada et al. | 242/56.2 |
| 4,391,415 | 7/1983 | Hollier, Jr. | 242/56.9 |
| 4,498,640 | 2/1985 | Nowak | 242/67.1 R |

FOREIGN PATENT DOCUMENTS 0145029 6/1985 European Pat. Off. .

*Primary Examiner*—John Petrakes

*Attorney, Agent, or Firm*—Watson, Cole, Grindle & Watson

[57] ABSTRACT

Apparatus for successively winding continuous strips of material into rolls includes one or a pair of spaced outstanding guide frames each having an outer frame member and an inner frame member defining upper and lower horizontal tracks for guiding slide bearings coupled to winding shafts. The inner frame member comprises a shiftable rectangular bar which is shifted rearwardly to define a forward vertical guide track interconnecting the horizontal tracks, and which is shifted forwardly to define a rearward vertical track interconnecting the horizontal tracks.

16 Claims, 9 Drawing Sheets

WINDING APPARATUS FOR CONTINUOUS STRIPS OF MATERIAL

BACKGROUND OF THE INVENTION

This invention relates to an apparatus for successively winding continuous strips of material into rolls, the apparatus including at least one upstanding guide frame for slide bearings of winding shafts for the material to be wound. The guide frame has an outer frame member and an inner frame member which together with the outer frame defines a guide track along which the slide bearings are guided.

The strips of material to be wound include paper, non-woven fabric, textiles, foil, strips of synthetic material such as thermoplastics, metal foil strips such as aluminum or copper, strip-shaped compound material such as coated paper strips, multi-layered plastic strips with individual layers of different plastic material, etc.

The term "winding" of rolls throughout this application is intended to also include the rewinding of rolls as understood in this art.

The apparatus provides for the rewinding of large rolls of the material into rolls of smaller diameter and/or smaller width. The apparatus may also be employed as a work station in installations which includes sheet dies for the extrusion of plastified thermoplastic material into plastic strips.

A problem encountered in the winding of rolls of material concerns maintaining the operational interruptions during the winding of successive rolls as short and as infrequent as possible to assure continuous operation of the apparatus.

A known apparatus of continuous operation has reversing winders with winding shafts arranged in the form of a rotary cross. However, costly auxiliary devices are required to assure an interrupted continuous operation.

European Patent No. 0 145 029 discloses an apparatus of the type generally described above as having an upstanding guide frame. At the input feed station for the strips of material, the ends of the winding shaft, on which a sleeve core for the roll to be wound is supported, are coupled to slide bearings and then moved to a roll forming station at which the strips are wound into rolls of a predetermined diameter. At the material infeed location spaced from the guide frame is provided an upstanding column with a height adjustable slide bearing which, in its upper position, is coupled to the free end of the winding shaft and is then lowered to the roll forming station together with a slide bearing supported in the guide frame.

After the roll is wound, the slide bearing on the column is decoupled from the winding shaft while the slide bearing supported in the guide frame, to which the winding shaft and wound roll is supported, is transported to a roll removal station by supporting the free end of the winding shaft by a guide rail.

During this interval the slide bearing on the column is raised to its upper position, is coupled to the free end of an empty winding shaft which is then lowered to the roll forming station for winding the next roll, and the aforedescribed operation is continued.

Another embodiment disclosed in this patent provides for a continuous roll winding operation by the provision of another upstanding guide frame having two coupling devices in place of the guide column with its height adjustable slide bearing. One of the coupling devices is coupled to the winding shaft on which a roll is wound, while the other coupling is coupled to the winding shaft on the next slide bearing of the other guide frame, and the winding shaft is lowered with its slide bearing and such other coupling device to the roll forming station at which, simultaneously, depending on the diameter of the roll to be wound, the respective winding shaft with the slide bearing end of the first coupling device is moved to the roll removal station such that after winding the last layer of the roll the strip is transversely cut forming a leading edge of the strip which is fed without interruption of the operation onto the sleeve core of the next winding shaft.

Problems may, however, be encountered particularly when the phase times, i.e., the winding times for the individual rolls, become very short.

Moreover, other problems could occur with operation with such a guide frame in that the closed guide track delineated by inner and outer frame members of the guide frame, is in the form of a rectangle or rhombus of such arrangement that unstable conditions for the slide bearings may be presented at the corners of the guide track since a plane support at the corners of the inner frame member cannot be provided.

A solution to this problem, although cumbersome, is to provide catches which reach behind the slide bearings in such a manner to prevent the instabilities at the corner areas.

SUMMARY OF THE INVENTION

The apparatus according to the invention avoids the aforementioned problems by the provision of at least one upstanding guide frame for the slide bearings of the winding shafts of material to be wound in such a manner that in the corners of a closed guide track the instabilities for the slide bearings are avoided and a continuous operation is assured even during extremely high track speeds of the material strips to be wound irrespective of varying diameters for successive rolls. And, the slide bearings have drives which can rotate as independent units.

In accordance with the invention an inner frame member is provided in the form of a shiftable rectangular bar which extends into an opening of an outer frame member and is shifted forwardly and rearwardly to respectively form rearward and forward vertical track segments interconnecting with upper and lower horizontal guide tracks formed between the inner and outer frame members. A closed guide track is thus formed in the shape of a parallelogram.

While the rearward vertical guide track, located at the feed area of the strip to be wound, is closed, a slide bearing is located in the lower horizontal guide track and a roll is wound on the sleeve core of its winding shaft. A slide bearing on the winding shaft on which a sleeve is supported is moved along the upper horizontal guide track in the direction of the feed area of the strip to be wound until it reaches a stop defined by the rearward end of that horizontal track. Since the rearward vertical guide track is closed, the slide bearing in the upper horizontal guide track is in a stable position. After a roll is wound on the winding shaft at the roll forming station, the incoming material strip is stopped and transversely cut. The winding shaft with the finished roll is decoupled and transported to the roll removal station, while the slide bearing and a coupling on an opposing slide column is raised and coupled to the free end of an empty winding shaft for the next roll to be wound.

The inner frame member is then shifted forwardly to open the rearward vertical track so that the empty winding shaft can now be lowered to the roll forming position and the material strip secured to the sleeve on the winding shaft to be wound into a new roll.

During this interval the previously wound roll is removed from the winding shaft at the roll removal station, the slide bearing with the now empty winding shaft is moved to the upper horizontal track to the rearward end thereof at which it is stopped after the bar is shifted rearwardly to open the forward vertical track, such that the stopped slide bearing is now located in a stable corner position.

After a roll is wound at the roll winding station it is transported to the roll removal station, the bar is shifted forwardly to open the rearward vertical track, the stopped slide bearing with its empty winding shaft is lowered to the roll forming station, and the operation continues as aforedescribed. The present apparatus therefore effects a continuous roll winding operation.

In accordance with another embodiment of the invention, the support column is replaced by another upstanding guide frame having an outer frame member and an inner frame member in the form of a shiftable rectangular bar extending into an opening thereof so as to define upper and lower horizontal guide tracks with the outer frame, as well as forward and rearward vertical guide tracks as the bar is respectively shifted rearwardly and forwardly. Slide bearings for the winding shafts are likewise guided along the closed track provided by this other guide frame, although such slide bearings are arranged to uncouple from the free ends of the winding shafts after each roll is fully wound. The apparatus according to this embodiment is of simpler and more economical construction and effects short time phases for a continuous roll winding operation.

The upper horizontal guide track or tracks can be formed in the manner of a magazine for the slide bearings and, depending on the length of the track(s), an appropriate number of slide bearings can be accommodated therealong.

The slide bearings may be provided with drive motors for transporting them along the guide tracks, and motor drives are provided for rotating the winding shafts and for operating the couplings for the winding shafts. The drives may be in the form of electric motors, hydraulic motors, or the like, which are flanged to he mounted on the slide bearings or are integrated with the slide bearings.

The drive motors may have pinion drives in meshed engagement with transport gears intermeshed with rack gearing provided on the outer frame members for transporting the slides along the guide tracks. The rack gearing can be likewise or alternately provided on the inner frame member.

The rack and pinion arrangement may also be provided in the vertical tracks for moving the slide bearings therealong. And, pneumatic or hydraulic cylinders may be provided on the outer frame member with plunger rods which extend and retract for pushing against opposite ends of the inner frame member bar for shifting the same forwardly and rearwardly. The plunger actuators are located on both guide frames and are operated in synchronization.

In lieu of plunger actuators for the bar, slide bearings may have upper pinion gears meshed with rack gearing on the bar with the slide bearing locked to the outer frame so as to effect shifting of the bar upon driving the pinion gear.

In accordance with another embodiment of the invention, one of the guide frames which support the slide bearings fixedly coupled to the winding shafts may have an open upper horizontal track providing access to such slide bearings and connected winding shafts for removal and replacement during maintenance and repair procedures.

DETAILED DESCRIPTION OF THE INVENTION

Figure 1:
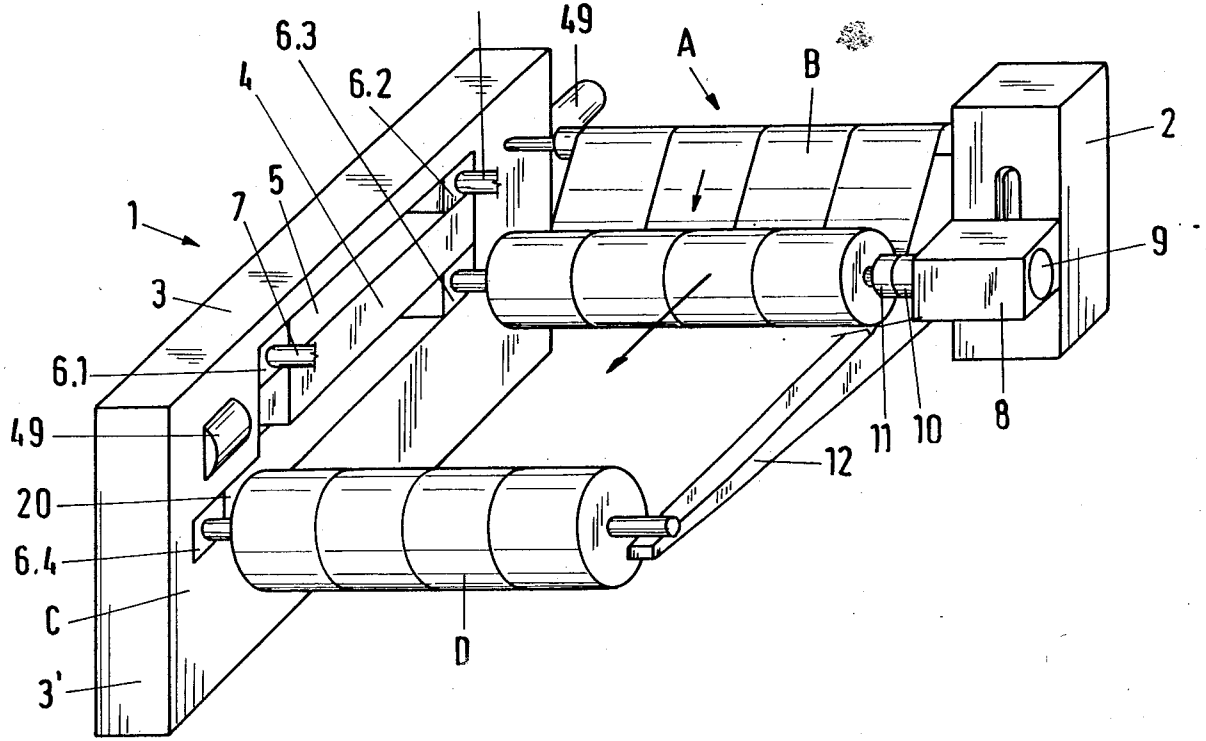
FIG. 1 is a schematic, perspective view of one embodiment of the apparatus according to the invention.

In one embodiment of the apparatus according to the invention, an upstanding guide frame 1 is located at one side of feed area A of the strip or strips of material B to be wound, and an upstanding support column 2 is located at the opposite side. C designates a roll removal station at which completely wound rolls D are removed.

The guide frame comprises a fixed outer frame member 3 having a rectangular opening, and an inner frame member 4 in the form of a shiftable rectangular bar extending into the opening and having a width less than the width of such opening so as to define a closed guide track 5 for slide bearings 6.1, 6.2, 6.3 and 6.4.

Winding shafts 7 are detachably coupled to the slide bearings at one end thereof for shaft rotation.

Column 2 has a height adjustable support bearing 8 with an electric drive motor 9 having a drive shaft 10 detachably coupled to the opposite end of a winding shaft via a detachable coupling 11. Motor 9 rotates the coupled winding shaft at the roll forming station shown in FIG. 1 with a roll in the process of being wound at the lowered position of slide bearing 6.3 and of bearing 8. Motor 9, or some other drive, may likewise be used for raising hearing 8 to its upper position (not shown) along column 2 at which it is aligned with the free end of an empty shaft 7 coupled at its opposite end to slide bearing 6.2.

A guide rail 12 is mounted on the inner side of column 2 for pivotable movement about a vertical or a transverse axis and extends substantially to the plane of front surface 3' of outer frame 3.

An elongated sleeve 7' (FIG. 9) is supported along the length of each winding shaft to provide a core on which the strip or strips of material are wound as in the usual manner. The sleeves may be splined or otherwise locked onto their shafts for rotation together with the shafts and are capable being axially removed together with a roll completely wound thereon.

The width of bar 4 is less than the width of the opening of the outer frame member so as to define upper and lower horizontal guide tracks 13 and 14. The bar is shown shifted forwardly in FIG. 2 so as to define a rearward vertical track 15 between the rearward end of the bar and an opposing end wall of the opening. The bar is shown shifted rearwardly in FIG. 3 so as to define a forward vertical guide track 16 between a forward end of the bar and an opposing end wall of the opening. The vertical tracks, when formed, interconnect the upper and lower horizontal tracks.

Outer frame member 3 also has a slot 20 defining a forward extension of lower guide track 14, the slot having an end wall defining a stop 21 for a slide bearing which has been transported to roll removal station C at which a completely wound roll is removed from its shaft.

Figure 2:
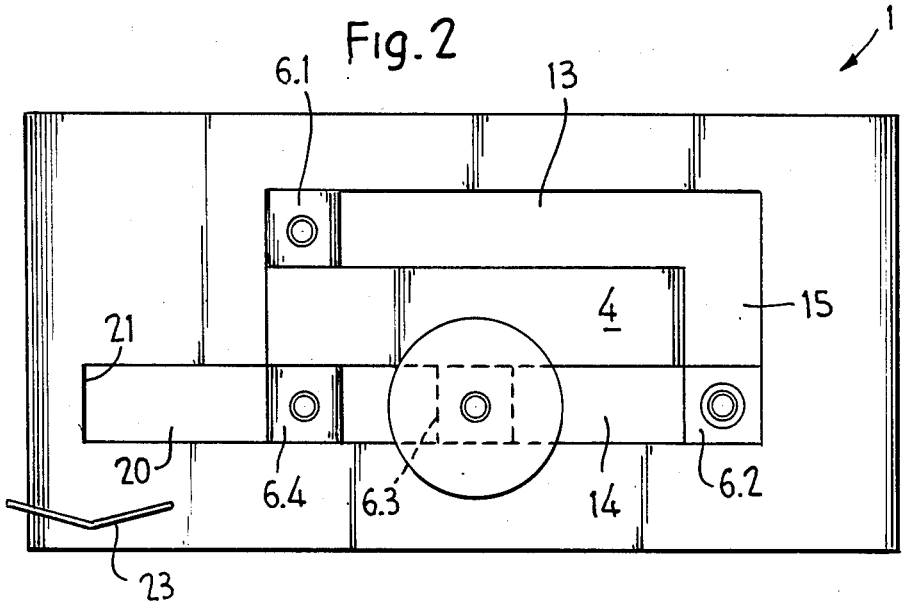
FIGS. 2 and 3 are side elevational views of the guide frame of FIG. 1 showing a rectangular bar of the inner frame member respectively shifted into its forward and rearward positions.

FIG. 2 illustrates a slide bearing 6.4 with an empty winding shaft after removal of the completely wound roll and in a position shifted rearwardly out of slot 20. Slide bearing 6.3 is illustrated as supporting a completely wound roll on its shaft and in the process of being transported toward the roll removal station. Slide bearing 6.1 is shown in the upper track, and slide bearing 6.2 is shown at the roll forming station in the process of winding a fresh strip of material onto its winding shaft, after cutting the material from the previously wound roll, in any normal manner. At the roll forming station the shaft on bearing 6.2 is coupled at its opposite end to motor 9 of bearing 8 and its speed of rotation is regulated with constant tension of the incoming material strip.

While the roll was being wound on the shaft of bearing 6.3 at the roll forming station of FIG. 1, bearing 6.2 was located in the upper horizontal track as shown with a core sleeve supported on its winding shaft.

After transversely cutting the strip of material and decoupling the free end of the winding shaft on bearing 6.3, this bearing with a completely wound roll on its shaft is transported along guide track 14 in the direction of the arrow shown in FIG. 2 toward the roll removal station.

After bearing 8 is decoupled from the shaft of bearing 6.3 at the roll winding station, bearing 8 is raised into alignment with the shaft of bearing 6.2 of FIG. 1 at the empty roll station. Bar 4 is then shifted forwardly, the empty shaft coupled to bearings 6.2 and 8 is lowered along track 15 to the roll winding station shown in FIG. 2, bar 4 is shifted rearwardly to its FIG. 3 position, bearing 6.1 is transported rearwardly until it stops at the end of upper track 13, bearing 6.4 is raised along forward vertical track 16 and moved into the upper track, and bearing 6.3 is now moved out of the lower track and into slot 20 until it reaches the roll removal station. Another roll is now wound onto the shaft of bearing 6.2, and the steps as aforedescribed are repeated.

After a roll is completely wound at the roll forming station and is uncoupled from drive shaft 10, the winding shaft is supported for guiding movement along guide rail 12 toward the roll removal station. At this station, a lifting platform 23 is raised to support the completely wound roll, guide rail 12 is pivoted away from the shaft it had supported, and platform 23 is moved axially of the shaft away from frame 3 for removal of the completely wound roll therefrom.

With the use of four slide bearings as aforedescribed, bar 4 is supported on a pair of spaced guide bearings located in lower track 14. Otherwise, bar 4 may be of a length greater than the length of the rectangular opening in the outer frame member minus the width of a vertical track 15, 16 so as to extend into an opening (not shown) located in the outer frame member for the cantilever support of bar 4 when shifted into either of its FIG. 2 or FIG. 3 positions.

It should be understood that roll winding is interrupted for a short period of time after the completion of a fully wound roll and before commencing the winding of another roll as the strip is transversely cast from the wound roll forming a leading end for threading onto an empty winding shaft.

Also, more than four slide bearings may be provided, such that the additional slide bearings will be located in upper track 13 while the bearings are shifted into and along the lower track as aforedescribed. The upper track thus functions also as a magazine.

Figure 4:
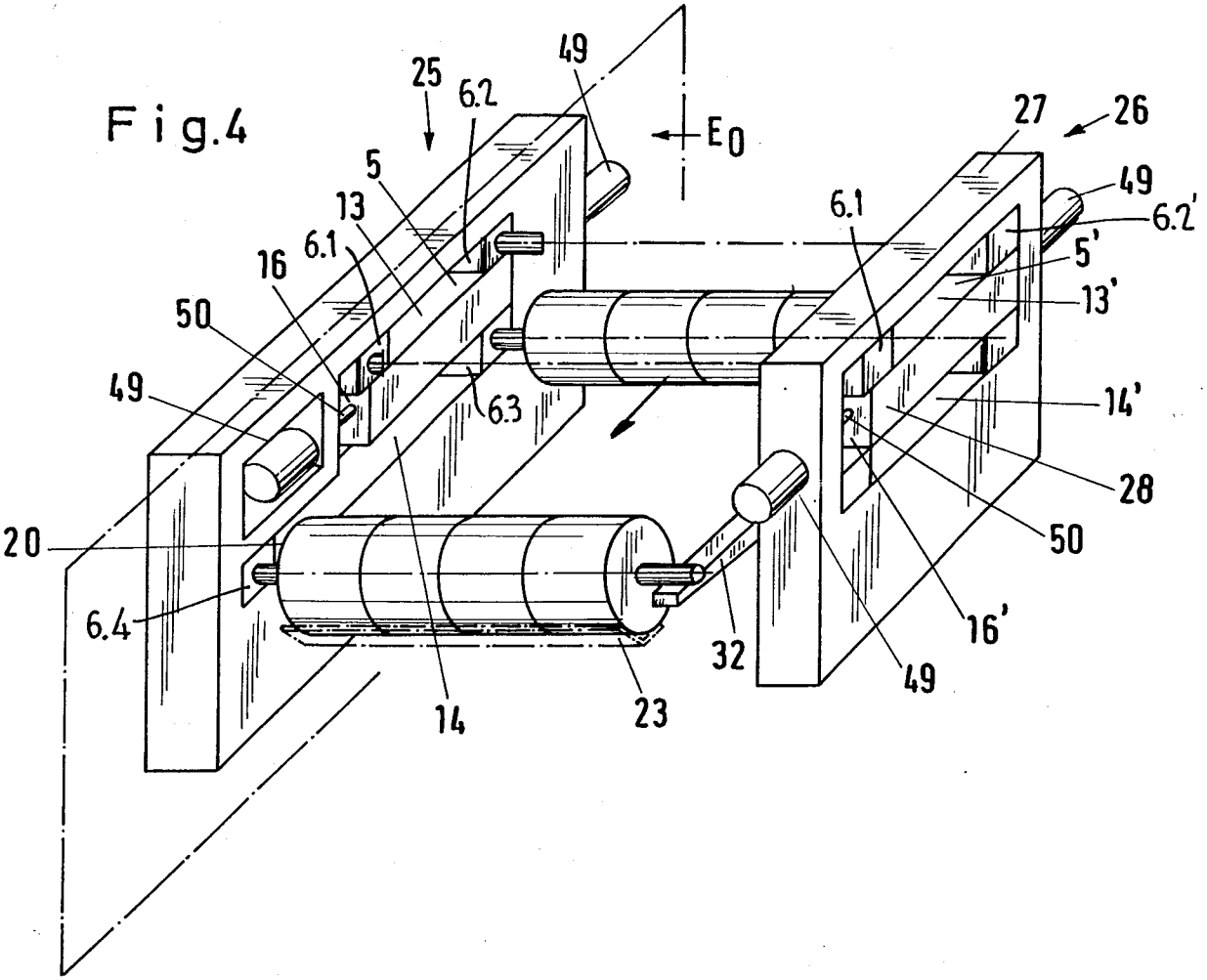
FIG. 4 is a schematic, perspective view of another embodiment of the apparatus of the invention.

Another embodiment of the invention is shown in FIG. 4 in which the apparatus includes a pair of laterally spaced upstanding guide frames 25 and 26. Guide frame 25 is the same as guide frame 3 of FIG. 1 and has slide bearings 6.1, 6.2, 6.3 and 6.4 each supporting winding shafts 7. Guide frame 26, which replaces column 2 of FIG. 1, has an outer frame member 27 with a rectangular opening and an inner frame member 28 in the form of a rectangular bar 4' of the same size as that of bar 4 and defining a closed track 5' of the same size and aligned with track 5 of guide frame 25. Slide bearings 6.1', 6.2', 6.3' and 6.4' are located in track 5', and are identical to support bearing 8 of FIG. 1 in that they each have an electric motor with a drive shaft and a coupling (not shown) for removably coupling to the free ends of winding shafts 7 extending from guide frame 25. Also, a guide rail 32 is mounted on the inside of guide frame 26 and extends to the plane of front surface 3' of outer frame 3 for guiding and supporting the shaft of a fully wound roll to the roll removal station, in the same manner as guide rule 12 of FIG. 1. And, guide rule 32 is mounted for pivotal movement away from the shaft which it had supported to facilitate removal without interference of a completed roll with the use of lifting platform 23 as aforedescribed.

Figure 3:
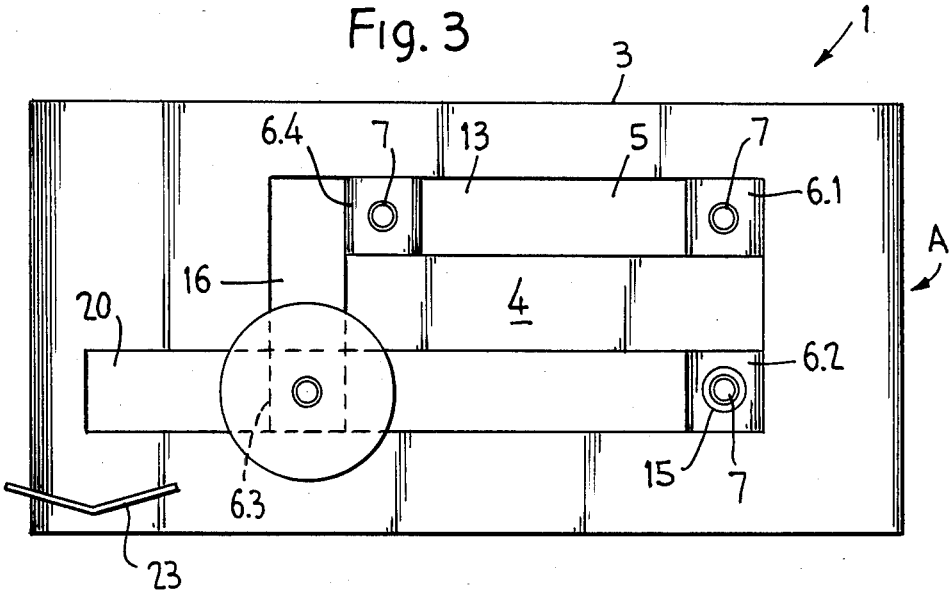
Figure 5:
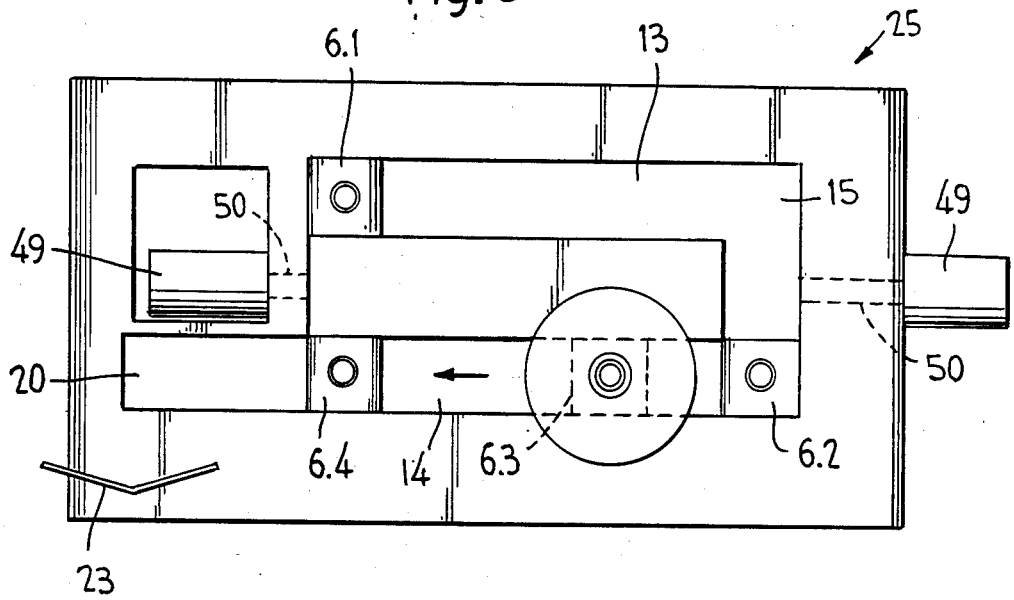
FIGS. 5 and 6 are side elevational views of the left most guide frame of FIG. 4 showing the rectangular bar of the inner frame member respectively shifted forwardly and rearwardly.
Figure 6:
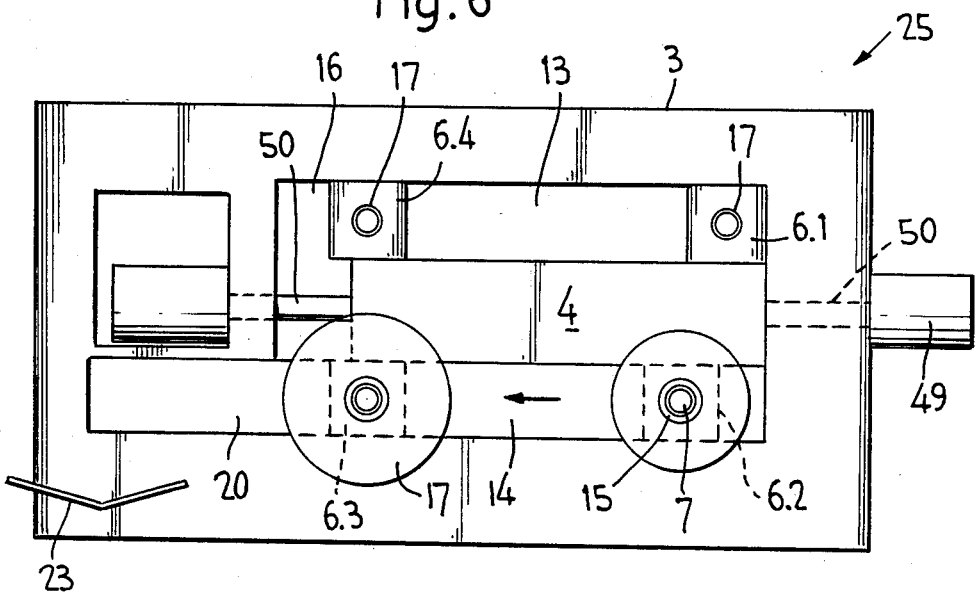
Figure 7:
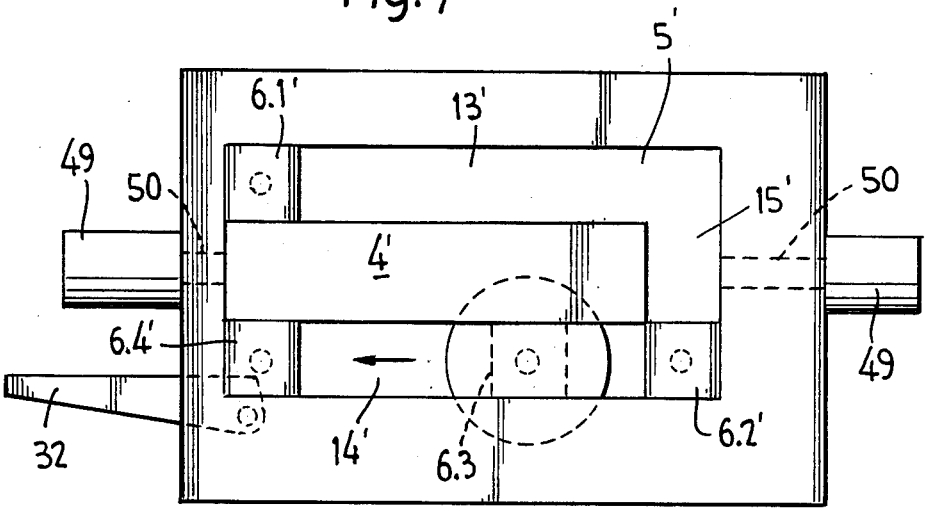
FIGS. 7 and 8 are side elevational views of the other frame member of FIG. 4 showing its rectangular bar shifted respectively into its forward and rearward positions.
Figure 8:
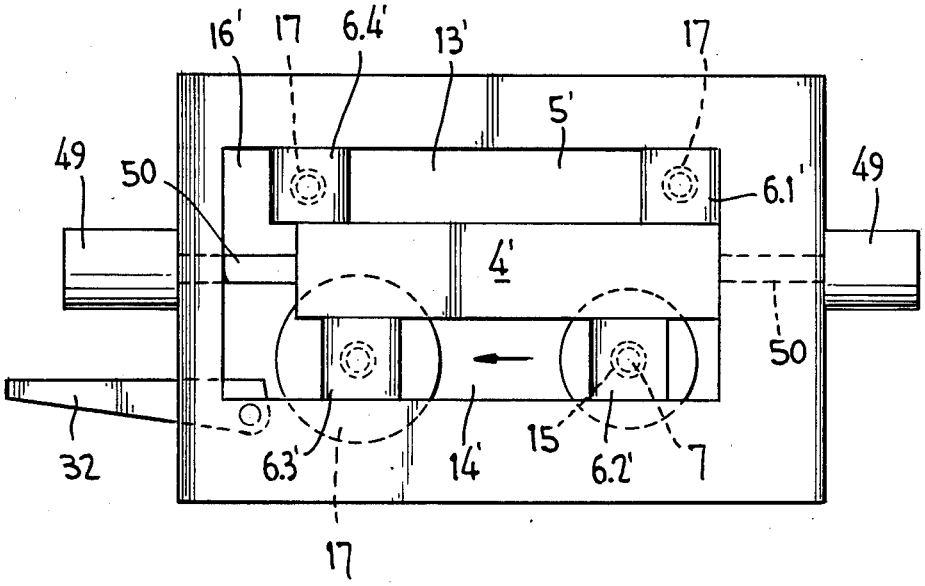

FIGS. 5 and 6 are essentially the same views as FIGS. 2 and 3 except for the positions of the individual slide bearings. FIGS. 7 and 8 correspond to FIGS. 5 and 6 for showing their relative positions of the slide bearings to guide frame 26.

Bar 4' functions in the same manner as that of bar 4, and both bars are operated in synchronization for defining the forward and rearward vertical tracks. The operation is similar to that described for FIG. 1 except that at the roll forming station bearing 6.3' is coupled to the winding shaft at this station and after a roll is completely wound bearings 6.3 and 6.3' are moved for transporting the completely wound roll along lower tracks 14 and 14' until bearing 6.3' reaches the end of the track at which bearing 6.4' had been located in FIG. 7. Bar 4' is then shifted rearwardly to its FIG. 8 position, bearing 6.1' is shifted rearwardly, bearing 6.4' is raised along track 16' and shifted rearwardly into the upper track, and bearing 6.3' is uncoupled from the fully wound shaft which is taken up by the guide rail 32 for guiding the completely wound roll to the roll removal station as shown in FIG. 4.

In the meantime, bearings 6.2 and 6.2' located at the roll forming station support a winding shaft on which a roll is being wound, a previously wound roll supported on bearings 6.3 and 6.3' progresses toward the roll removal station, bars 4 and 4' are shifted rearwardly allowing bearings 6.4 and 6.4' to be raised along vertical tracks 16 and 16' and to be moved into the upper tracks of their guide frames. In the meantime, bearings 6.1 and 6.1' are moved to the rearward ends of their upper tracks at which they are stopped, after which bars 4 and 4' are shifted forwardly to open rearward vertical tracks 15 and 15' allowing bearings 6.1 and 6.1' to be lowered to the roll forming station. The bearings of guide frame 26 are coupled to the winding shaft and are uncoupled as they respectively reach the forward ends of their lower track, but are again coupled to the empty winding shaft (empty roll station(s)) after removal of the fully wound rolls therefrom and after the associated bearing of guide frame 25 is moved rearwardly out of slot 20.

The apparatus according to the FIG. 4 embodiment can operate continuously.

Figure 9:
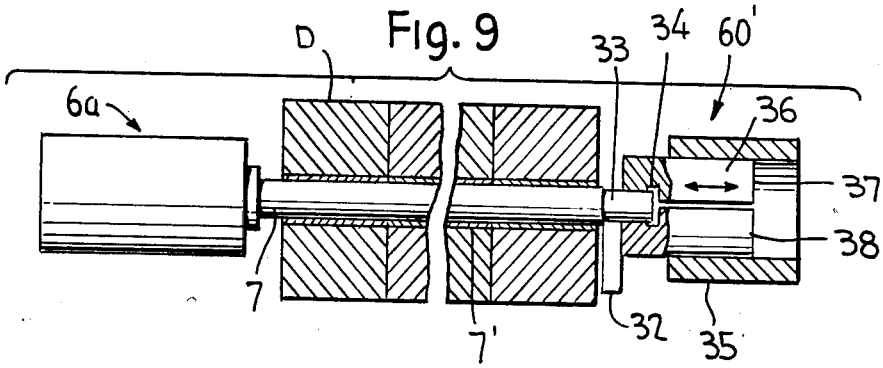
FIG. 9 is a detailed view, partially in section, of a typical winding shaft having a fixedly coupled slide bearing at one end and a removably coupled slide bearing at its other end.

FIG. 9 illustrates a winding shaft 7 supporting a wound roll having a slide bearing 6*a* (corresponding to bearings 6.1, 6.2, 6.3 and 6.4) fixedly coupled to one end of the shaft, and having a slide bearing 6'*a* (corresponding to bearings 6.1', 6.2', 6.3' and 6.4') removably coupled to the opposite ends of the shaft. The winding shaft is freely rotatable in bearings 6*a* and 6'*a*. A core sleeve 7' is shown supported along the length of the shaft on which a roll or rolls D are wound. The free end of the shaft is in the form of a plug 33 having a circular end disc 34. In housing 35 of slide bearing 6'*a* is an axially disconnectable coupling 36 having coupling jaws 37 and 38 which engage about disc 34 in the coupled position. After loosening the coupling jaws the plug end 33 is freed from bearing 6'*a* and is led to guide rail 12 of FIG. 1 or to guide rail 32 of FIG. 4.

Figure 10:
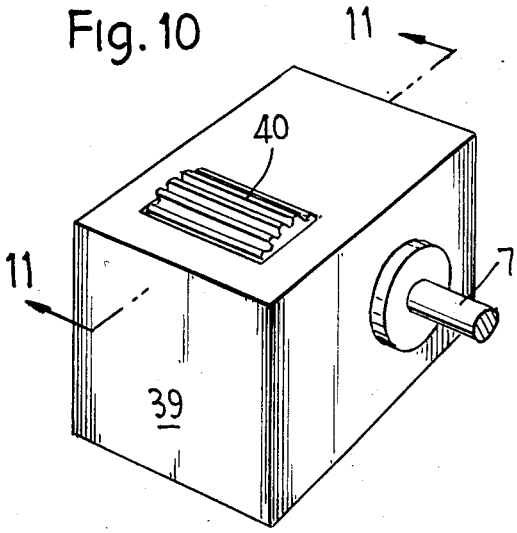
FIG. 10 is a perspective view of a slide bearing showing its transport gearing.
Figure 11:
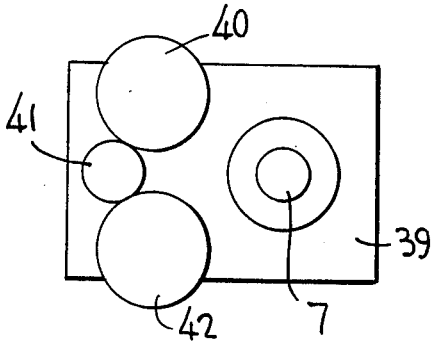
FIG. 11 is a sectional view of the slide bearing taken substantially along the line 11—11 of FIG. 10.
Figure 14:
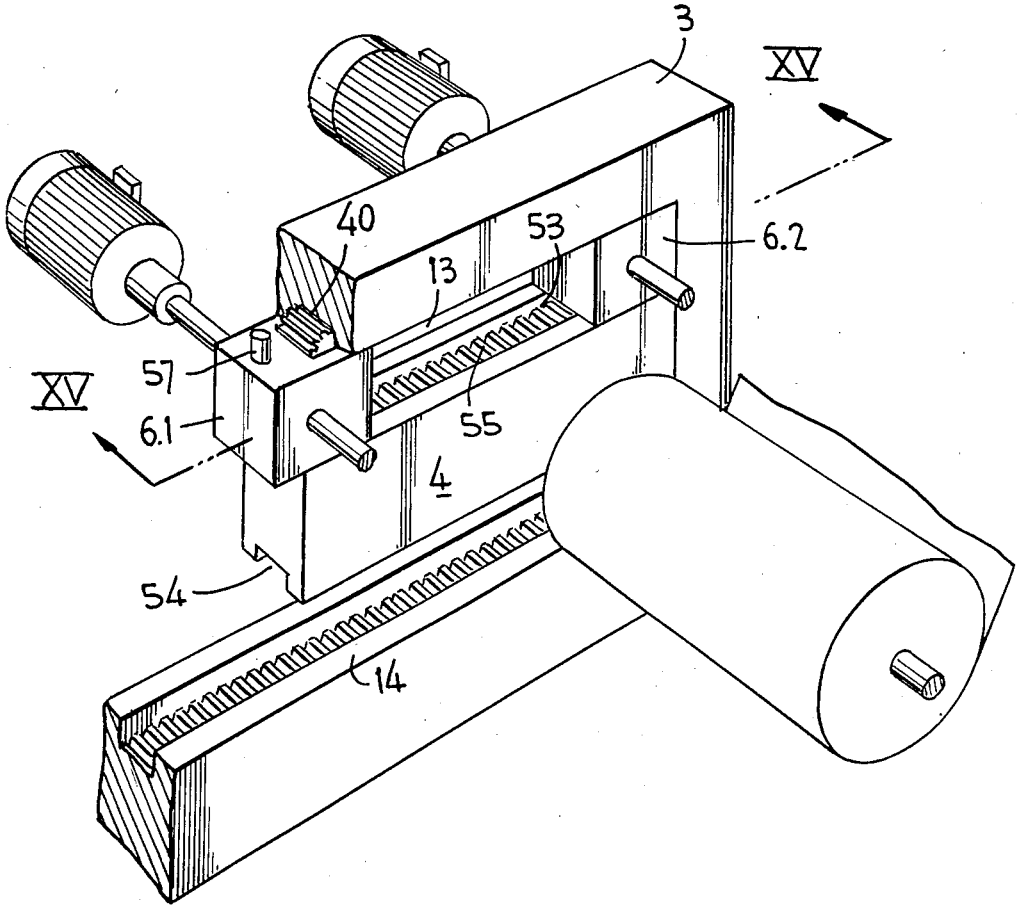
FIG. 14 is a perspective view of a guide frame illustrating an alternative manner of shifting the inner frame member bar.

FIGS. 10 and 11 show an embodiment for slide bearing 6*a* and/or 6'*a*. It has a housing 39 in which the end of winding shaft 7 is mounted for free rotation, and has a toothed transport wheel 40 extending outwardly of its upper wall. Similarly, a toothed transport wheel 42 extends outwardly of its bottom wall, and both transport wheels are intermeshed with a pinion gear 41 (FIG. 11) driven by an electric motor 48. Transport wheels 40 and 42 intermesh with rack gearing provided along the confronting edge walls of the respective outer and inner frame members, as shown in FIG. 14, for transporting the slide bearing along the upper and lower tracks. The guide bearings may be moved along the forward and rearward vertical tracks by the provision of push rods actuated by hydraulic or pneumatic cylinders (not shown) located below the lower ends of the vertical tracks.

Figure 12:
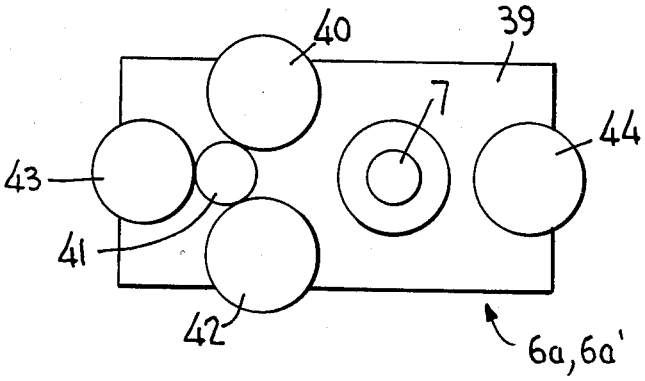
FIG. 12 is a view similar to FIG. 11 of another embodiment of a slide bearing.

Another embodiment of slide bearing 6*a* or 6'*a* is shown in FIG. 12 in which additional toothed transport wheels 43 and 44 are provided intermeshing with toothed rack gears located on the confronting end walls of the outer frame member for transporting the slide bearings along the forward and rearward vertical tracks. Wheel 43 is rotated by pinion gear 41, and wheel 44 is separately driven in some usual manner.

Figure 13:
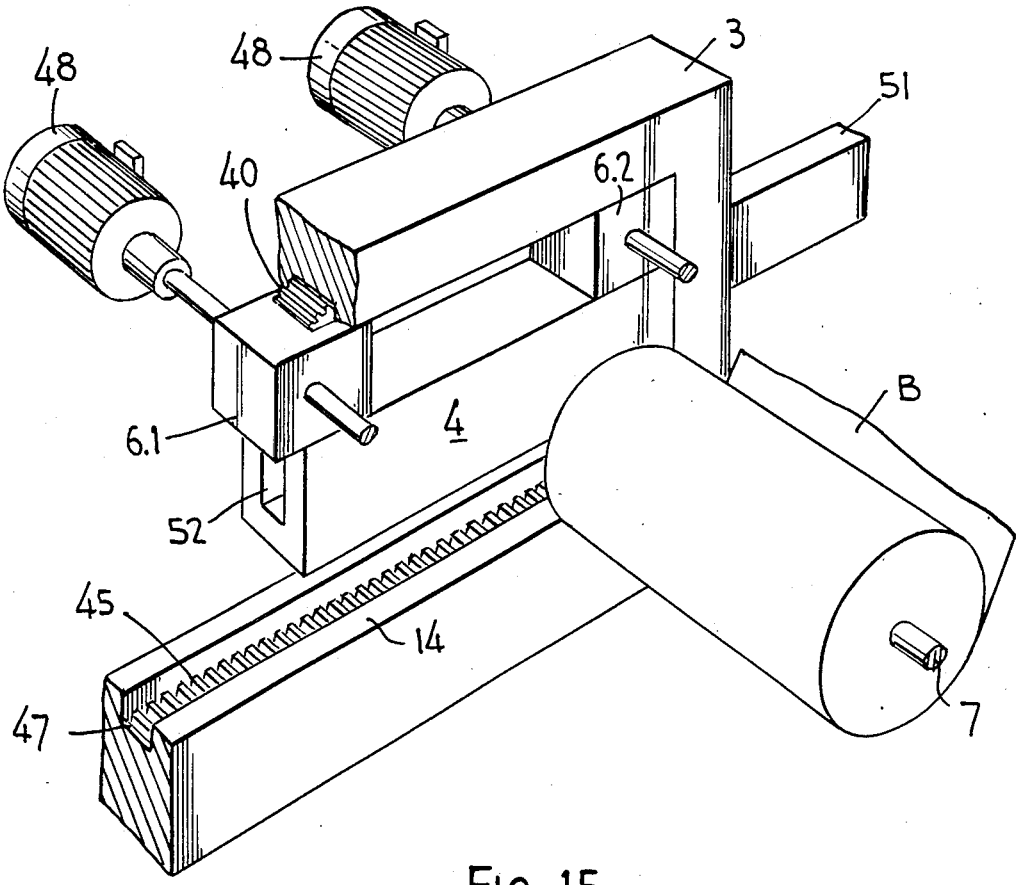
FIG. 13 is a perspective view of a guide frame with alternative measures for shifting the inner frame member bar.

Rack gearing 45 located in a longitudinal guide groove 47 is shown in FIG. 13 located on a wall of the outer frame member at track 14 which confronts bar 4. Such rack gearing may likewise be located on the confronting edge wall of bar 14, and such rack gearing is likewise located on a wall of the outer frame end member which confronts an upper side of bar 14 in track 13. Such rack gearing may likewise be located on such upper side of the bar 4. The slide bearing shown in FIGS. 10 and 11 is thus accommodated in the upper and lower tracks and is movable therealong upon operation of electric motors individually associated with each slide bearing for rotation of its pinion gear 41. Motors 48 are coupled to winding shafts 7 of their respective slide bearings for rotation of the winding shafts at the roll forming station, and may be coupled via suitable gearing to gear 41.

Rack gearing such as 47 may likewise be provided on one or both confronting edge walls of the outer and inner frame members at vertical tracks 15 and 16 when slide bearings such as that shown in FIG. 12 are employed. Otherwise, if the slide bearings of FIGS. 10, 11 are utilized, such rack gearing in the vertical tracks need not be provided. Instead, pneumatic or hydraulic pistons (not shown) are flange mounted on the bottom surface of the outer frame member in alignment with the vertical tracks, and plunger rods thereof extend through the outer frame for bearing against the slide bearings for respectively raising a slide bearing in track 16 upon extension of the plunger rod, and for lowering the slide bearing in track 15 upon retraction of the plunger rod. The plunger rods are, of course, retracted out of the vertical tracks to avoid interference when bar 4 is shifted.

To effect the longitudinal shifting of bars 4 and 4', pneumatic or hydraulic cylinders 49 (FIGS. 1 and 4) are mounted on the outer frame members with their respective plunger rods 50 bearing against the opposed end walls of the bars when extended to effect forward and rearward shifting. Of course, the plunger rods are fully retracted out of the vertical tracks when the bar is shifted in either direction.

Such cylinders and plunger rods may be replaced by roller wedges 51 shown in FIG. 13 operated by a suitable drive D which project into end pockets 52 of the bars when extended for shifting the bars. Wedge 51 may remain engaged with pocket 52 when the bar is shifted (e.g., rearwardly as in FIG. 13) for supporting the bar relative to the outer frame member when the bar is so shifted.

Figure 15:
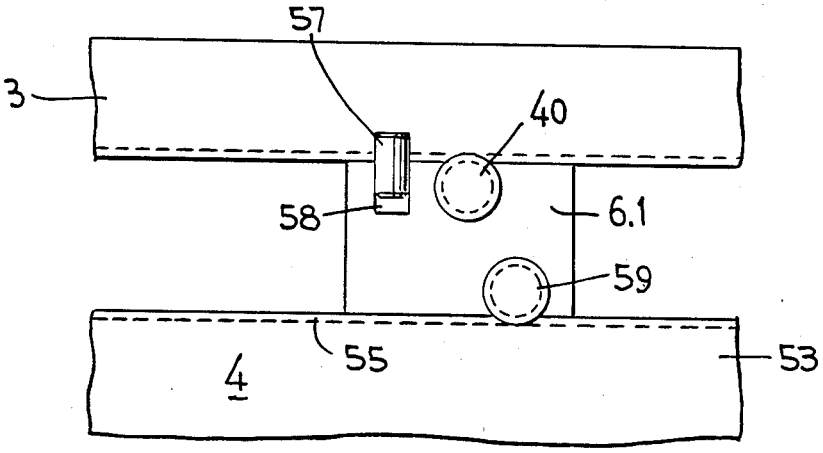
FIG. 15 is a sectional view taken substantially along the line 15—15 of FIG. 14.

FIGS. 14 and 15 illustrate an arrangement for shifting bars 4 and 4' without the need for plunger rods or roller wedges. The slide bearings such as 6.1 effect bar shifting by the provision of a lock bolt 57 which is projected outwardly of its pocket 58 (FIG. 15) in some normal manner and into a socket (not shown) located in the outer frame manner. The slide bearing is thus locked relative to the outer frame, and a drive pinion 59 mounted in the slide bearing engages the teeth of gearing 55 located in groove 53 on the bar. Rotation of pinion gear 59 therefore shifts the bar in the given direction depending on the direction of rotation of the pinion gear. Gearing in a bottom groove 54 may likewise be provided on the bar in meshed engagement with a pinion gear of a slide bearing located in the lower track to effect a shifting of the bar after such slide bearing is locked to the outer frame member in the same manner as described with reference to FIG. 15. Of course, lock bolt 57 would extend downwardly rather than upwardly as shown to effect locking.

As the bar is shifted, the lock bolt 57 is retracted into its pocket 58, and the other pinion gear 40 is rotated to transport the slide bearing along the upper or lower track in meshed engagement with rack gearing on the outer frame member.

Figure 16:
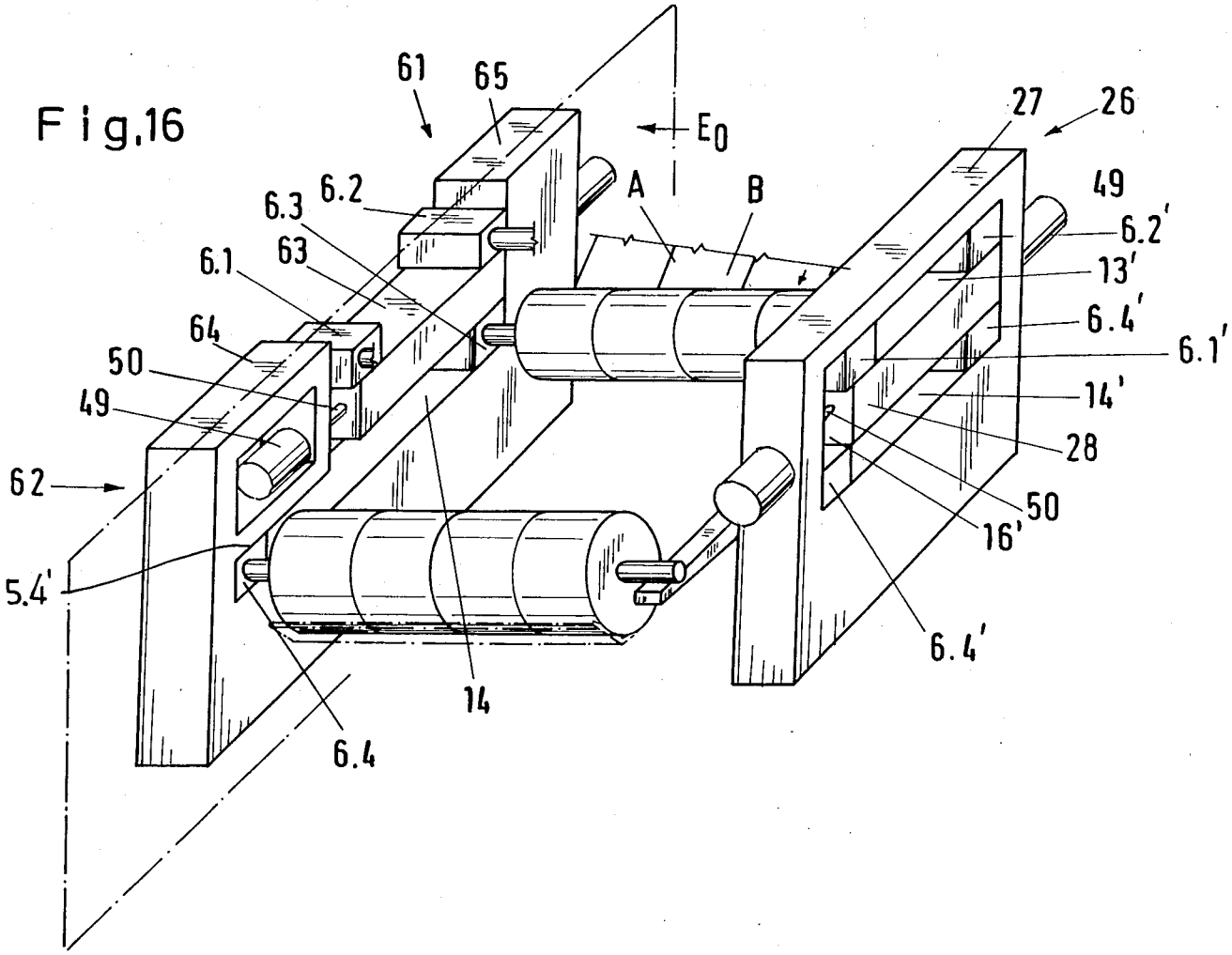
FIG. 16 is a view similar to FIG. 4 of yet another embodiment of the invention.

Another embodiment of the apparatus of the invention is shown in FIG. 16 which is similar to that of FIG. 4 with like parts having like reference numerals. Guide frame 61 includes an outer frame member 62 and an inner frame member 63, the latter being the same in construction and operation as the inner frame member of FIG. 4. However, the outer frame member has an upwardly open slot, rather than a rectangular opening, as defined by a pair of spaced legs 64 and 65. Thus, rather than a closed guide track of FIG. 4, an open guide track is provided for guide frame 61 of FIG. 16 so that the winding shafts with their slide bearings can be removed and replaced for maintenance and repair with the use of a suitable crane or the like. Otherwise, movement of the slide bearings and operation of the winding procedures are carried out the same as described with reference to FIGS. 1 and 4. Frame 26 of FIG. 16 can also have an open upper track without departing from the invention.

What is claimed is:

1. Apparatus for successively winding continuous strips of material into rolls, comprising a first upstanding guide frame comprising a first outer frame member having a rectangular opening a first inner frame member in the form of a shiftable rectangular bar extending into said opening and having a width less than the width of said opening so as to define upper and lower horizontal guide tracks with said outer frame member, said bar being longitudinally shiftable within said opening between a first position defining a forward vertical guide track between a forward end of said bar and an opposing end wall of said opening, and a second position defining a rearward vertical guide track between a rearward end of said bar and an opposing end wall of said opening, said outer frame member having a slot defining a forward extension of said lower guide track, first slide bearings rotatably supporting a plurality of winding shafts at one end thereof and being movable along said tracks from a roll forming station at said lower guide track to a roll removal station at said extension and to and from said upper guide track at empty roll stations via said vertical guide tracks as determined by the shifted position of said bar, and support means having movable means removably coupled to an opposite end of one of said shafts for rotatably supporting at least said one shaft at said roll forming station.

2. The apparatus according to claim 1, wherein said support means comprises a support column, and said movable means comprises a support bearing mounted on said column for vertical movement between said roll forming station and one of said roll empty stations for coupling to another of said shafts thereat.

3. The apparatus according to claim 1, wherein said support means comprises a second upstanding guide frame comprising a second outer frame member having a second rectangular opening, a second inner frame member in the form of a shiftable rectangular second bar extending into said second opening and having a width less than the width thereof so as to define second upper and lower horizontal guide tracks with said second outer frame member, means for shifting said second bar within said second opening between said first position defining a forward vertical second guide track between a forward end of said second bar and an end wall of said second opening, and said second position defining a rearward vertical second guide track between a rearward end of said second bar and an opposing end wall of said second opening, said second tracks being aligned with said first tracks, said movable means comprising second slide bearings removable coupled to opposite end of said shafts, rotatably supporting said shafts and being movable along said second tracks.

4. The apparatus according to claim 3, further comprising means for moving said first and second slide bearings along said first and second tracks.

5. The apparatus according to claim 4, wherein said moving means comprise driven pinion gears on said first and second slide bearings in toothed engagement respectively with rack gearing on said outer frame members.

6. The apparatus according to claim 5, wherein means are provided for locking one of said slide bearings in one of said horizontal tracks, said one bearing having another driven pinion gear and said bar having rack gearing meshed with said another gear, whereby said bar is shifted by operation of said another gear.

7. The apparatus according to claim 3, further comprising means on said first and second outer frame members for longitudinally shifting said bars in opposite directions and in synchronization for defining said vertical tracks.

8. The apparatus according to claim 7, wherein said shifting means comprise extendable and retractable plunger rods which alternately bear against said forward and rearward ends of said bars.

9. The apparatus according to claim 3, further comprising bar supports on said first and second outer frame members movable to engage said bars for supporting said bars upon shifting thereof.

10. The apparatus according to claim 3, wherein said first outer frame member further has an open upper end providing access to said bearings located in said upper track.

11. The apparatus according to claim 1, further comprising means for moving said first slide bearings along said tracks.

12. The apparatus according to claim 11, wherein said moving means comprise driven pinion gears on said slide bearings in toothed engagement with rack gearing on said outer frame member.

13. The apparatus according to claim 12, wherein means are provided for locking one of said slide bearings in one of said horizontal tracks, said one bearing having another driven pinion gear and said bar having rack gearing meshed with said another gear, whereby said bar is shifted by operation of said another gear.

14. The apparatus according to claim 1, further comprising means on said outer frame member for longitudinally shifting said bar in opposite directions for defining said vertical tracks.

15. The apparatus according to claim 14, wherein said shifting means comprise extendable and retractable plunger rods which alternately bear against said forward and rearward ends of said bar.

16. The apparatus according to claim 1, further comprising bar supports on said outer frame member movable to engage said bar for supporting said bar upon shifting thereof.

* * * * *